US009289673B1

(12) United States Patent
Allen

(10) Patent No.: US 9,289,673 B1
(45) Date of Patent: Mar. 22, 2016

(54) GOLF CAGE SYSTEM

(71) Applicant: Dillis V. Allen, Schaumburg, IL (US)

(72) Inventor: Dillis V. Allen, Schaumburg, IL (US)

( * ) Notice: Subject to any disclaimer, the term of this patent is extended or adjusted under 35 U.S.C. 154(b) by 0 days.

(21) Appl. No.: 14/168,091

(22) Filed: Jan. 30, 2014

(51) Int. Cl.
*A63B 69/36* (2006.01)
*A63B 71/02* (2006.01)
*A63B 63/00* (2006.01)

(52) U.S. Cl.
CPC ..... *A63B 71/022* (2013.01); *A63B 63/00* (2013.01); *A63B 69/36* (2013.01)

(58) Field of Classification Search
CPC ..... A63B 2063/006; A63B 63/00; A63B 71/022; A63B 2210/50
USPC ..... 273/398–402; 473/172, 190, 191, 195, 473/197, 421
See application file for complete search history.

(56) References Cited

U.S. PATENT DOCUMENTS 4,153,246 A * 5/1979 Byrne ..... 473/197
4,180,352 A * 12/1979 Divers et al. ..... 405/303
4,183,524 A * 1/1980 Kifferstein et al. ..... 473/435
5,007,645 A * 4/1991 Weigl et al. ..... 473/197
5,116,056 A * 5/1992 Schmutte ..... 473/172
5,277,430 A * 1/1994 Naccarato ..... 473/446
5,409,230 A * 4/1995 Dunaway et al. ..... 473/161
5,524,901 A * 6/1996 Bison et al. ..... 473/197
5,571,266 A * 11/1996 Nichols ..... 473/446
5,664,784 A * 9/1997 Redlich et al. ..... 273/396
5,725,444 A * 3/1998 Heden ..... 473/446
5,876,291 A * 3/1999 Dubose ..... 473/197
5,947,831 A * 9/1999 McCarthy ..... 473/197
5,993,334 A * 11/1999 McNamara ..... 473/446
6,485,373 B1 * 11/2002 Stephens ..... 473/197
6,969,068 B1 * 11/2005 Pollon et al. ..... 273/400
7,293,776 B2 * 11/2007 Fenwick ..... 273/400
2012/0322567 A1 * 12/2012 Manieri ..... 473/151

* cited by examiner

*Primary Examiner* — Mark Graham
(74) *Attorney, Agent, or Firm* — Dillis V. Allen, Esq.

(57) ABSTRACT

A golf cage system that uses the customer's garage door tracks as the frame for the cage. The cage is oriented to transfer loads from ball impact through the tracks to the frame of the door in a perpendicular direction to minimize track twisting. The cage has a ball striking drop panel suspended from a shaft mounted on rollers or end caps that ride in the tracks and fastened to the tracks in their active position. Side panels and a top panel are also supported on the rollers at their forward ends and supported on another set of rollers in the tracks at the distal ends of the tracks. Low profile tie-downs are epoxied to the concrete garage floor to facilitate unobstructed foot and tire traffic.

14 Claims, 6 Drawing Sheets

GOLF CAGE SYSTEM

BACKGROUND OF THE INVENTION

Golf cages require framing as well as netting and the frames contribute in many cases more than 50% of the cost of manufacturing the cage.

Golf cage systems in the garage have been increasingly popular because they enable the golfer to practice during inclement weather. Because these cages are designed for outdoor use, they frequently create an errant ball hazard when erected and used in the garage.

It is a primary object of the present invention to ameliorate these problems in garage located golf cages and provide a lower cost golf cage system for the garage.

SUMMARY OF THE PRESENT INVENTION

In accordance with the present invention, a golf cage system is provided that uses the customer's garage door tracks as the frame for the cage. The cage is oriented to transfer loads from ball impact through the tracks into the frame of the door in a perpendicular direction to minimize track twisting. The cage has a ball striking drop panel suspended from a shaft mounted on rollers or end caps that ride in the rails and fastened to the tracks in their active position. Side panels and a top panel are also supported on the rollers at their forward ends and supported on another set of rollers in the tracks at the distal ends of the tracks. Low profile tie-downs are epoxied to the concrete garage floor to facilitate unobstructed foot and tire traffic.

The cage system is stored by rolling the panels around the shaft and shifting the rolled panels rearwardly to the distal ends of the tracks. A linkage assembly is provided that enables the shaft and main rollers to swing downwardly from the tracks so the shaft clears the door operator hardware.

There are two embodiments disclosed herein. The first is a commercial quality golf cage that uses locking roller sets and the second is an economy model that can be sold to many more customers at a price of as low as about $19.00 US at today's dollar value.

The economy model includes a forward panel supporting telescopic tube that adjusts axially to accommodate limited side track spacing variations. The tube is supported on end caps that are locked to the side rails by threaded fasteners in the range of ½ inch in diameter.

This cage system can be used as well for other sports such as batting cages.

Other objects and advantages will appear more clearly from the following detailed description.

DETAILED DESCRIPTION OF THE PREFERRED EMBODIMENTS

Figure 1:
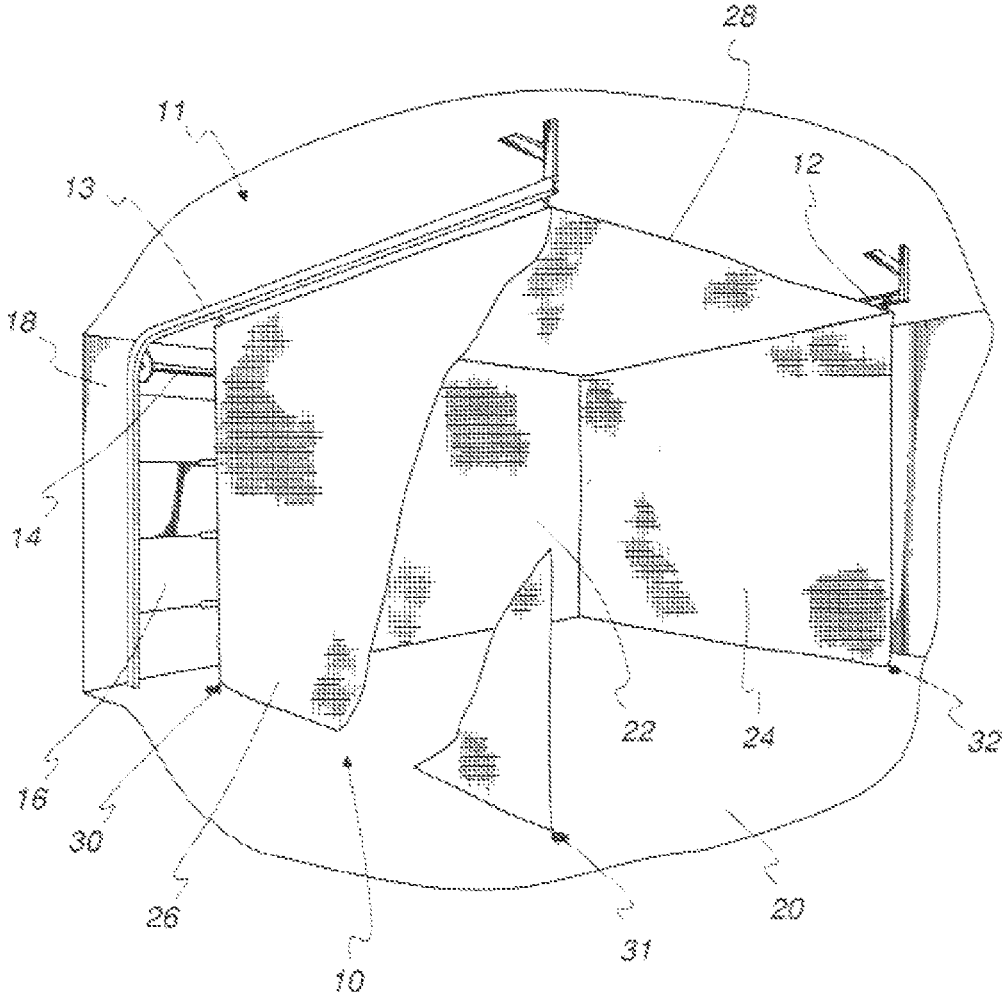
FIG. 1 is a perspective view of a typical garage interior with the present golf cage system installed in its active operable position.

Referring to the drawings and initially to the perspective of FIG. 1, a golf or sports cage system is generally designated by the reference numeral 10 and is seen to be supported in a standard garage door opening and dosing system 11 including a left track 12, a right track 13, a torsion spring assembly 14 permitting a segmented door assembly 16 to open and close from its closed position illustrated in FIG. 1. The tracks 12 and 13 are supported by brackets shown in FIGS. 2 and 5 on a door frame 18. The tie-downs for the golf cage system 10 are permanently affixed to the concrete garage floor 20, as will be seen from the following views.

The golf cage system 10 is supported on the horizontal portion of the side tracks 12 and 13 and is seen to include a forward ball striking double panel 22, a left side panel 24, a right side panel 26, and a top panel 28.

It should he understood that the panels 22, 24, 26 and 28 can be constructed of a netting material common in the golf net industry, which applies to other sports industries such as baseball, and can also include panels that are canvas or vinyl reinforced, for example, and possibly other panel materials. The forward double panel 22, as will be seen in the other views, consists of a rear panel that is preferably a net material and a forward ball striking panel that can be canvas or a nylon reinforced vinyl material. The forward panel 22 is affixed to the floor by tie-down assemblies 30, and the side panels 24 and 26 are fixed to the floor 20 by tie-down assemblies 31 and 32 below the distal ends of the door side tracks 12 and 13.

Figure 2:
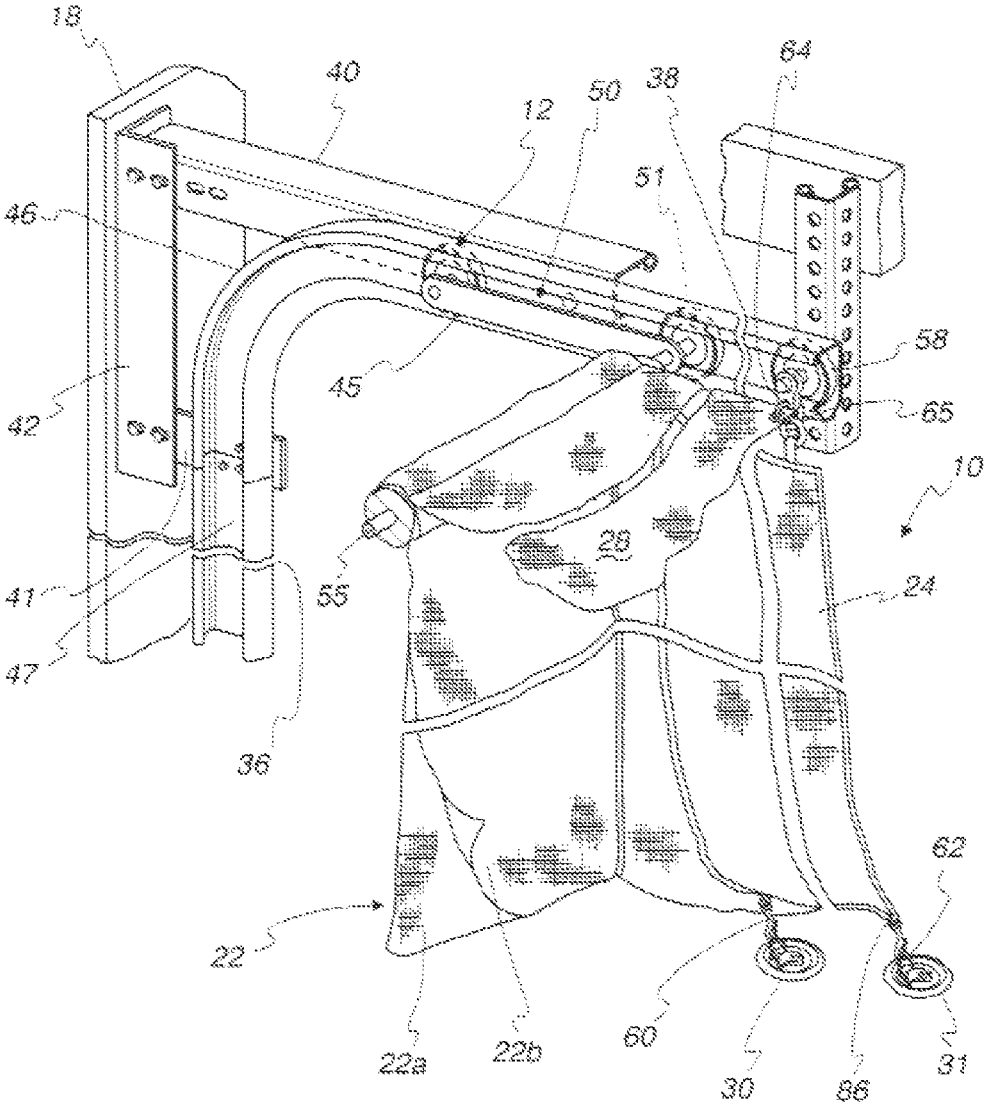
FIG. 2 is a fragmented perspective of the left door track of a typical garage door installation showing the roller mechanism for the golf cage system in its operative position including the stowage linkage assembly and the distal roller for supporting the ends of the side panels and the top panel along with the low profile tie-down assembly shown mounted on the garage floor. Note that in FIG. 2 the horizontal and the vertical portions of the track are broken away to facilitate the enlarged part view in FIG. 2.

Referring to FIG. 2, which is a fragmented perspective view of the left door track 12, it should be noted that the track is fragmented at 36 and 38 so that FIG. 2 can be shown larger to aid in the clarity of the parts.

Figure 3:
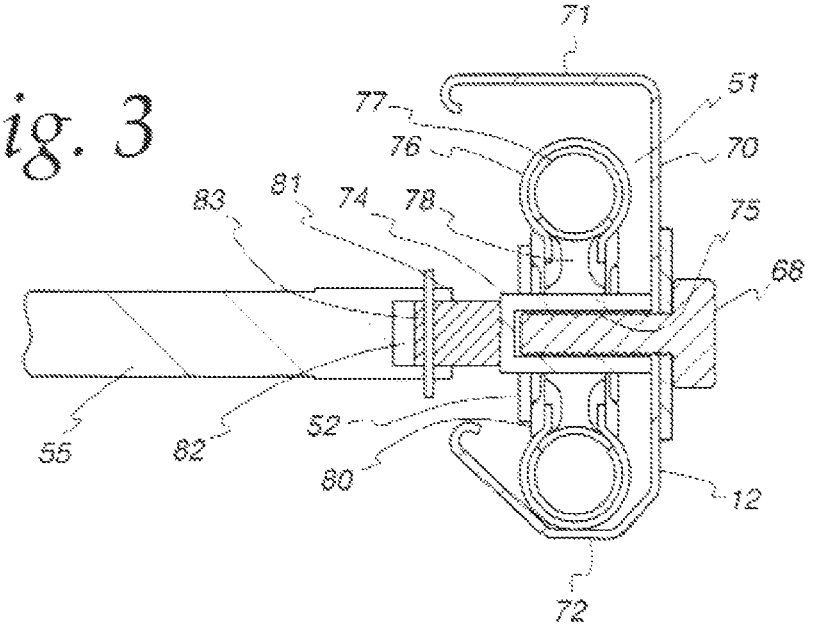
FIG. 3 is a cross section of the left door track with the left main roller assembly shown in cross section and locked to the door track in its active position.

The track 12 is channel-shaped in cross section as shown in FIG. 3, and is supported on the door frame by brackets 40, 41 and 42 that are arranged generally perpendicular to the door frame 18. The orientation of the double ball striking panel 22 parallel to the door 16 and spaced from but adjacent the door 16 and door frame 18 enables the ball impact forces on the double panel 22 to be transferred axially through the tracks 12, 13, through the brackets 40, 41, and 42 into the door frame 18 in a direction perpendicular to the door frame 18 to minimize the twisting forces at ball impart imposed by the double wall 22 on the tracks 12 and 13, which is an important aspect of the present invention.

The tracks 12, 13 have a horizontal portion 45, a 90 degree bend portion 46, and a vertical portion 47. The golf cage system 10 is supported in the horizontal portion of the tracks 12, 13 so that the double ball striking wall 22 is positioned approximately three feet from the door 16, but the door spacing can be varied depending upon the integrity of the double wall 22. Note that the double wall 22 includes a forward netting panel 22*a* and a rear ball striking panel 22*b* that may be canvas or nylon reinforced vinyl for example.

Figure 4:
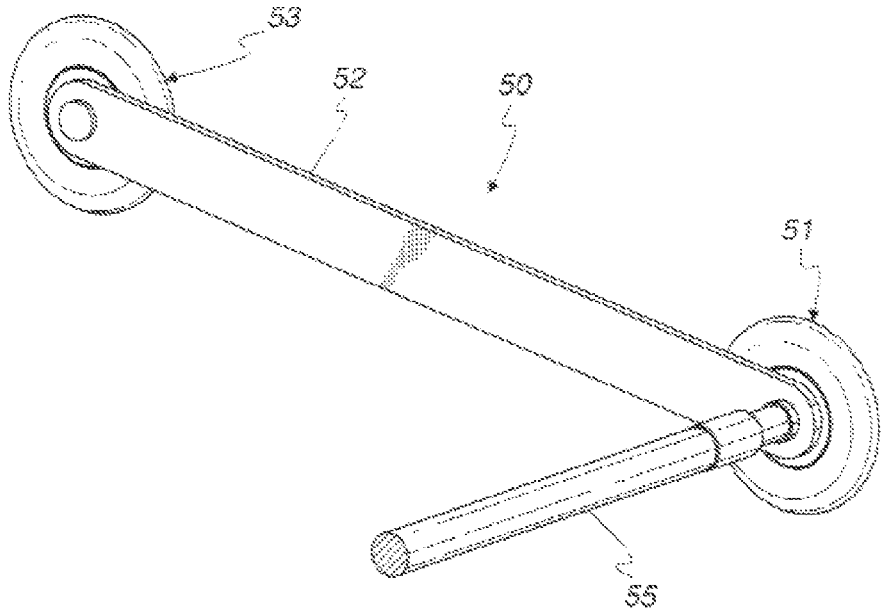
FIG. 4 is a sub-assembly illustrating the stowage linkage assembly for the left door track.

As seen in FIGS. 2, 3 and 4, the golf cage system 10 is supported at its forward ball striking end by a double roller linkage assembly 50 that includes a main roller assembly 51 and a link 52, and a stowage roller 53.

The main roller assembly 51 supports a cross shaft 55 that supports all the forward ends of the netting panels and extends between the tracks 12 and 13 where a mirror image of the roller linkage assembly 50 is supported in the right door track 13. A rear roller assembly 58 is mounted in the rear end of the side tracks 12, 13 and supports the upper reaches of the side panels 24 and 26 and the top panel 28.

Figure 7:
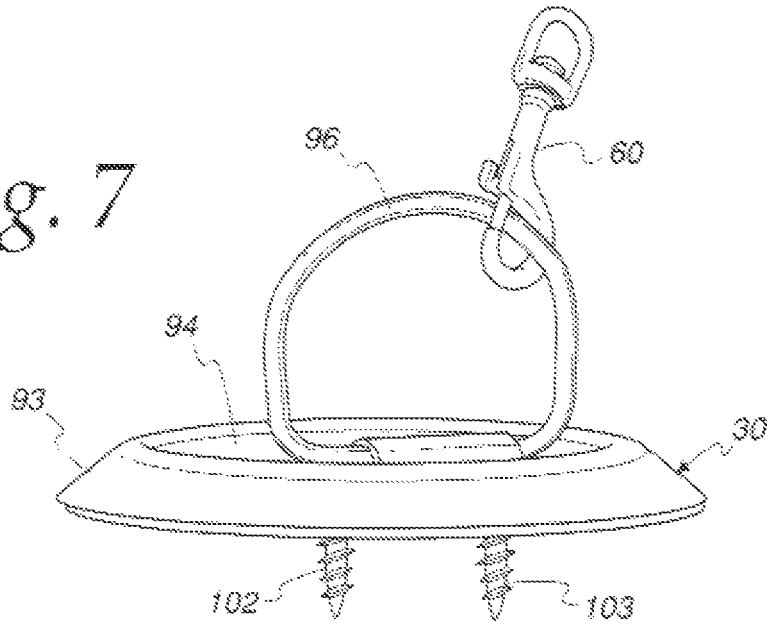
FIG. 7 is a front perspective of the tie-down illustrated in FIG. 6 with a snap hook attached thereto.

The sides of the double front panel 22 are fixed on concrete floor 20 by a pair of tie downs 30 that include snap hooks 60 shown in FIG. 7, and as noted the rear end of the side panels are tied to the floor 20 by the low profile tie-down 31 and an identical snap hooks 62 to snap hooks 60.

The rear ends of the top panel 28 and the side panels 24 and 26 are tied to the rollers 28 by snap hooks 64 and 65 as seen in FIG. 2.

The main roller assembly 51 illustrated in FIG. 3 is shown mounted in the channel-shaped left rail 12 and fixed thereto by a threaded fastener 68. The channel track 12 is a mirror image of the channel track 13 and is seen to include horizontal wall 70, top wall 71, and cup-shaped lower wall 72 in which the roller assembly 51 is locked by bolts 68, which requires the user to drill holes in the tracks 12, 13 at the proper locations.

Viewing FIG. 3, the roller assembly 51 supports the cross shaft 55 and is seen to include a cylindrical base 74 having a threaded aperture 75 therein that threadedly receives the bolt 68 and as the bolt 68 is threaded into aperture 75 it draws rod portion 74 against the interior of the rail wall 70 firmly locking the roller assembly 51 to the rails 12, 13. The roller assembly includes annular outer tread 76, a race 76*a*, a plurality of ball bearings 77, an inner annular race 78 that rides against the ball bearings 77, and a side race assembly 80.

The main roller assembly includes a cylindrical rod portion 81 that fits in an elongated bore 82 in the ends of the shaft 55 that with cross rod 83 permits an axial adjustment in the length of the rod 55 to accommodate limited variations in the spacing between the side tracks 12, 13. Other arrangements besides the bore 82 and cross rods 83 can accommodate the same axial length adjustment for the shaft 55 as will appear to those with engineering skills in the mechanical arts.

The roller assemblies 53 are not locked to the tracks 12, 13, while the roller assemblies 58 are lacked to the rear end of the rails 12, 13 in the position illustrated in FIG. 2 with bolt fasteners such as fastener 68 illustrated in FIG. 3, requiring the customer to drill suitable apertures in the side rails 12, 13 to accommodate and permit the rollers 58 to be fixed to the rails.

The fixation of the roller assemblies 58 keeps the side panels 24, 26 and the top panel 28 in a taut position as shown in FIG. 1.

Figure 5:
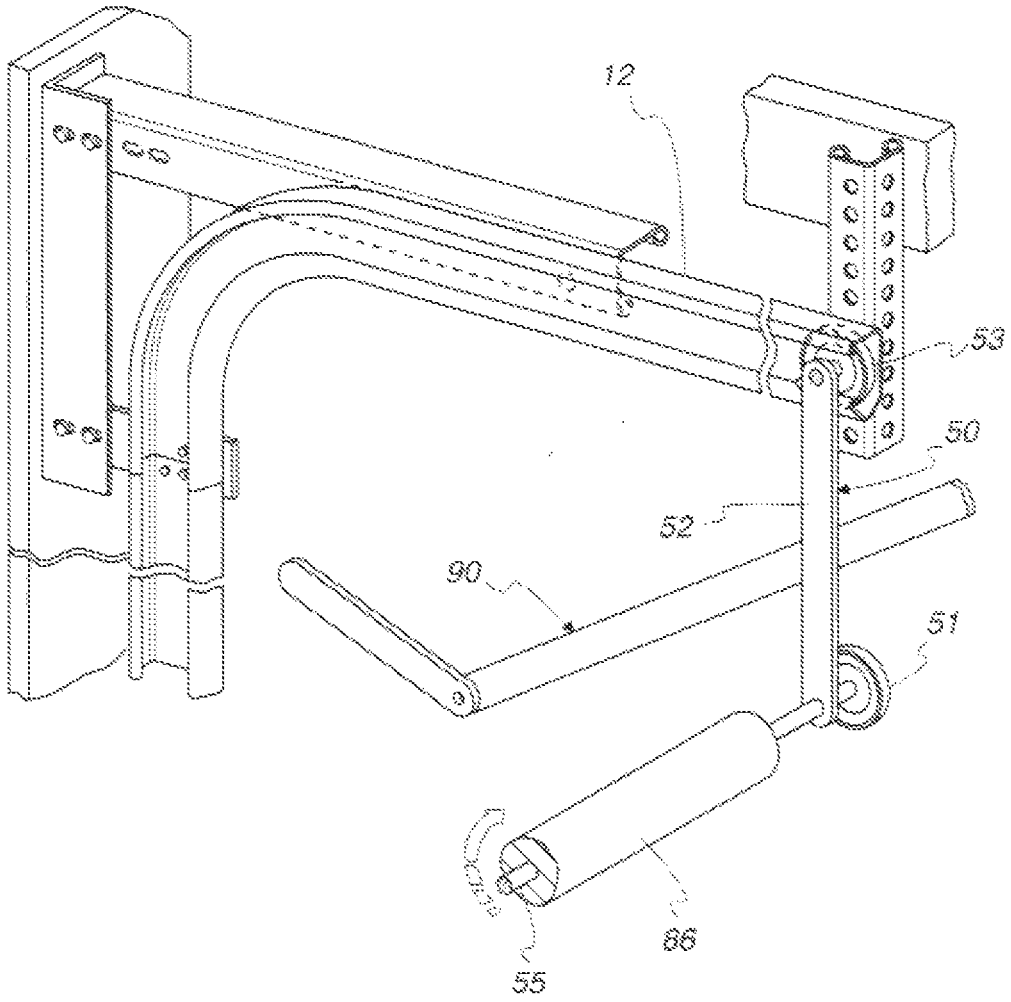
FIG. 5 is a fragmented perspective view of the left door track similar to FIG. 2 with the golf cage system shown in its stowed position.

Viewing FIG. 1, the golf cage system is stowed by releasing the tie-downs 31, 32, 30 and snap hooks 64, 65, folding the side panels 24, 26 against the double wall panel 22, then folding the top panel downwardly against the folded panels, and then rolling the four panels around the shaft 55 into a bundle 86 illustrated in FIG. 5 which is larger in diameter than illustrated in FIG. 5 for simplicity.

This manipulation can be affected by attaching a crank, not shown, to the reduced rod portion 81 of the main bearing assemblies 51 and rotating the crank to facilitate this maneuver. Otherwise, it can also be done simply by hand grasping the bundle 86 and rotating it to roll up the panels onto the singular shaft 55.

After the bolt fasteners 68 are removed, the roller assemblies 51 with the linkage assembly 50 are shifted to the rear end of the tracks 12, 13 and when the roller assemblies reach 53 reach the distal end of the tracks 12, 13 as seen in FIG. 5, the linkage assembly is swung downwardly to the position illustrated in FIG. 5 with the linkage assembly vertical and the roller assemblies 51 suspended and supporting the rolled panels 86 as shown. The purpose of the linkage assembly 50 is to locate shaft 55, roller assemblies 51, and the material 86 out of the way of door operating linkages 90 commonly found in automatic door openers and closers in today's technology.

The rollers 53 may be locked in the position illustrated in FIG. 5 to prevent the inadvertent misplacement of the golf cage system in its stowed position.

An important aspect of the present invention is that the tie-down assemblies 30 are low profile to permit both tire traffic and human traffic on the garage floor 20 without any significant impediment.

Figure 6:
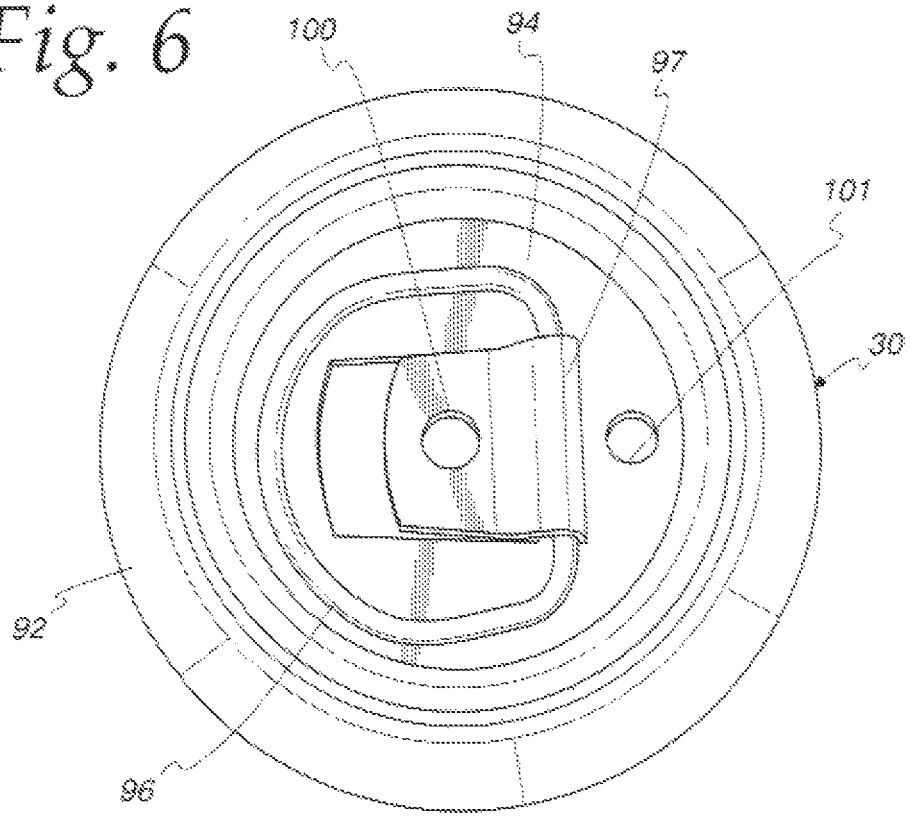
FIG. 6 is an enlarged top view of the low profile tie-downs illustrated in FIG. 2.

As seen in FIGS. 6 and 7, the tie-down assembly 30 is circular in configuration and has a major diameter of about 2 to 3 inches and a height of less than 0.500 inches and preferably closer to 0.250 inches. The snap hook assembly 60 is conventional and used throughout the present golf cage system at the four locations illustrated in FIG. 1, as well as the upper locations as indicated at 64 and 65 in FIG. 2. It should be understood that the snap hook assemblies are connected to loops 86 tethered to the panels 24, 26, 28 and the double panel 22.

The low profile tie-down assembly 30 includes a one-piece circular annular stamping 92 having a frusto-conical portion 93 with an included angle of about 30 degrees to facilitate tire traffic and to not impede foot traffic. An inner portion of the circular tie down assembly 30 circular portion 94 is recessed from the upper surface of the frusto-conical portion 23 so that a pivoting ring 96 is seated in the recess portion 94 and is flush with the upper surface thereof when the tie down assembly 30 is in its inactive position shown in FIG. 6.

The tie-down assembly 30 includes a looped ring support 97 welded to the upper surface of the recess portion 94 and the assembly includes holes 100 and 101 to receive screws 102 and 103 to affix the tie-downs 30 to the garage floor. The securement of the tie downs 30 to the garage floor may be enhanced by abrading the upper surface of the concrete floor in the area of installation, and applying epoxy to the lower surface of the pleat 92 and at the same time drilling holes for the screws 102 and 103 in the floor and permitting the epoxy to cure overnight. The epoxy is preferably an RT cure epoxy material that is easy for the customer to use. It is also possible that depending upon the loads on the golf cage system to affix the tie-downs 30 to the concrete floor with epoxy only, although it is preferably done in an ambient environment above 50 degrees F.

Figure 8:
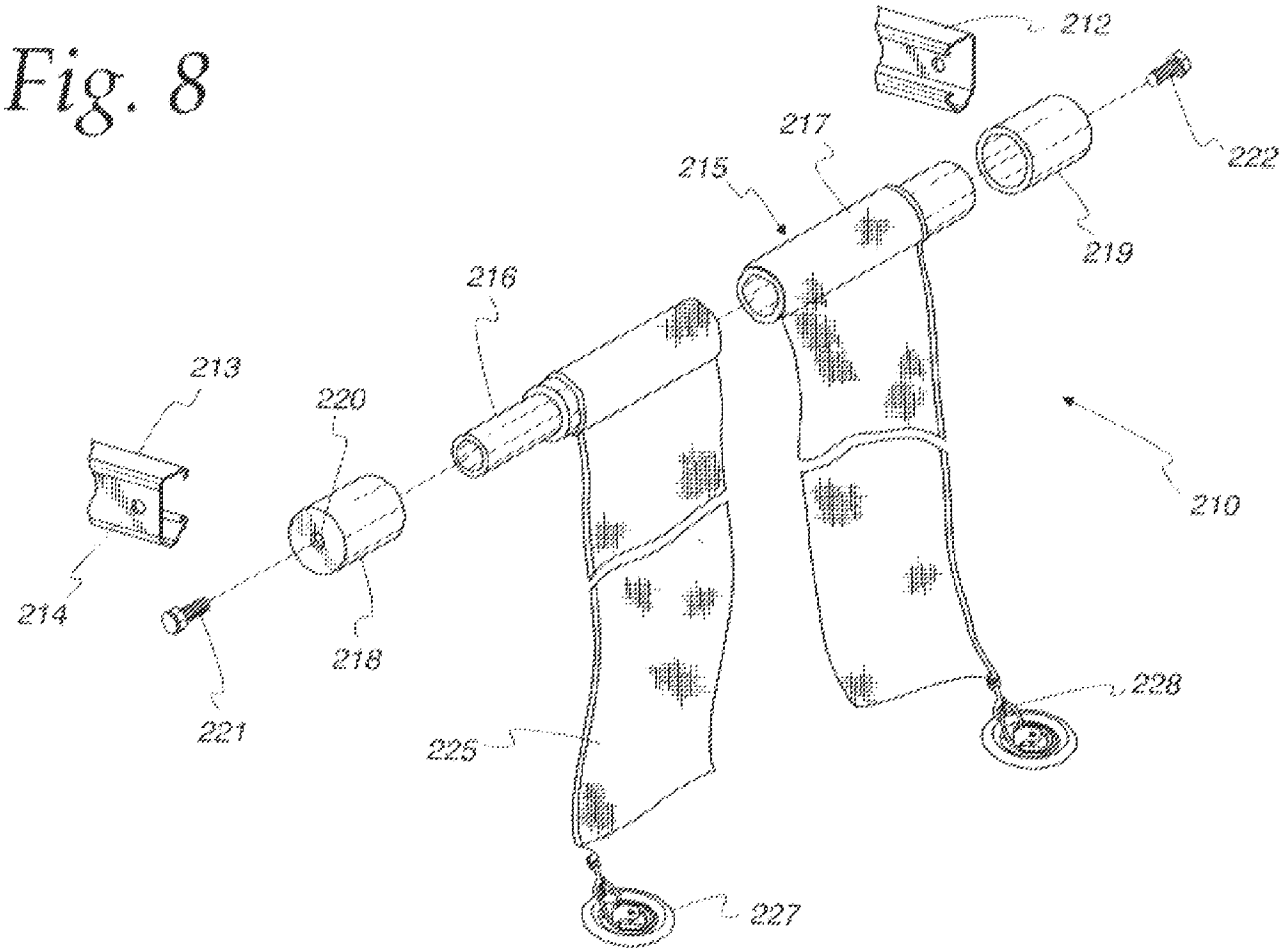
FIG. 8 is a perspective partly segmented view of an economy model golf cage system according to the present invention.

FIG. 8 is a perspective partly segmented view of an economy model golf cage system according to the present invention.

This golf cage system is generally designated by the reference numeral 210 and is seen to include a net supporting telescopic metal tube 215 supported on door tracks 212 and 213. Tube 215 has sections 216 and 217 adjustable axially to accommodate limited track spacing variations.

The ends of tube 215 are fixed into the hollow end caps 218 and 219 which are fixed into the tracks 213 and 212 by heavy threaded fasteners 221 and 222 that extend through holes 214 in the tracks 212 and 213 into threaded apertures 220 in the caps 218 and 219.

Ball striking net 225 is suspended from tube 215 by a plurality of loops and the lower end of the net is tethered to the concrete floor by tie-downs 227 and 228 identical to those in the FIGS. 1 to 7 embodiment.

The invention claimed is:

1. A sports cage assembly and garage frame combination for a preexisting garage frame configuration, comprising: a garage frame including a door frame structure including spaced side frame members, a cross header connecting the side members, a pair of spaced tracks connected to the door frame structure each including a vertical portion merging into a generally horizontal portion extending away from the door frame structure, a frameless sports cage subassembly suspended from and fixed to the spaced tracks including a pair of first base members fixed in the tracks generally parallel to and spaced from the door frame structure, and a forward ball impact panel extending across and between the base members and downwardly therefrom, wherein the spaced tracks are channel-shaped in cross section and the base members are each end caps fixed to the spaced tracks by fasteners into the channel-shaped tracks.

2. A sports cage assembly and garage frame combination as defined in claim 1, including side ball impact panels extending rearwardly from the forward panel along the horizontal portion of the tracks, and connectors for attaching a rear portion of the side panels to a rear portion of the horizontal track portions.

3. A sports cage assembly and garage frame combination as defined in claim 1, including a top ball impact panel extending rearwardly from the forward panel along the horizontal portion of the tracks, and connectors for attaching a rearward portion of the top ball impact panel to a rear portion of the horizontal track portions.

4. A sports cage assembly and garage frame combination as defined in claim 1, including a pair of tie-down assemblies for attaching a lower portion of the forward ball impact panel to a horizontal floor surface including a low profile ring assembly less than one-half inch in height and permanently attached to the floor surface, and a clip assembly attachable to the ring assembly and connected to a lower end of the forward ball impact panel.

5. A sports cage assembly and garage frame combination as defined in claim 1, including a second pair of base members in the side tracks spaced from and connected to the first base members for supporting the forward ball impact panel below the spaced tracks in a stowed position.

6. A sports cage assembly and garage frame combination for a preexisting garage frame configuration for a garage door retraction assembly, comprising: a garage frame including a door frame structure including spaced side frame members, a header connecting the side frame members, a pair of side tracks connected to the door frame structure each including a vertical portion merging into a generally horizontal portion extending away from the door frame structure, a frameless sports cage subassembly suspended from and fixed to the spaced side tracks including a pair of first base members fixed in the tracks generally parallel to and spaced from the door frame structure, and a forward ball impact panel extending across and between the base members and downwardly therefrom, wherein the spaced tracks are channel-shaped in cross section and the base members are each end caps fixed to the spaced tracks by fasteners extending into the channel-shaped spaced tracks.

7. A sports cage assembly and garage frame combination as defined in claim 6, including side ball impact sheets extending rearwardly from the forward panel along the horizontal portion of the tracks, and connectors for attaching a rear portion of the side panels to a rear portion of the horizontal track portions.

8. A sports cage assembly and garage frame combination as defined in claim 6, including a top ball impact panel extending rearwardly from the forward sheet along the horizontal portion of the tracks, and connectors for attaching a rearward portion of the top ball impact panel to a rear portion of the horizontal track portion.

9. A sports cage assembly and garage frame combination as defined in claim 6, including a pair of tie-down assemblies for attaching a lower portion of the forward ball impact panel to a horizontal floor surface including a low profile ring assembly less than one-half inch in height and permanently attached to the floor surface, and a clip assembly attachable to the ring assembly and connected to a lower end of the forward ball impact panel.

10. A sports cage assembly and garage frame combination as defined in claim 6, including a second pair of base members in the side tracks spaced from and connected to the first base members for supporting the forward ball impact panel below the spaced tracks in a stowed position.

11. A sports cage assembly for a preexisting garage frame configuration comprising: a door frame structure including spaced side frame members, a header connecting the side members, a pair of spaced tracks connected to the door frame structure each including a vertical portion merging into a generally horizontal portion extending away from the door frame structure, a frameless sports cage subassembly suspended from the spaced tracks including a pair of first base members fixed in the tracks generally parallel to and spaced from the door frame structure, and a forward ball impact panel extending across and between the base members and downwardly therefrom, wherein the spaced tracks are channel-shaped in cross section and the base members are end caps fixed to the spaced tracks by fasteners extending through the channel-shaped spaced tracks, including side ball impact panels extending rearwardly from the forward panel along the horizontal portion of the tracks, and connectors for attaching a rear portion of the side panels to a rear portion of the horizontal track portions.

12. A sports cage assembly as defined in claim 11, including a top ball impact panel extending rearwardly from the forward sheet along the horizontal portion of the tracks, and connectors for attaching a rearward portion of the top ball impact panel to a rear portion of the horizontal track portions.

13. A sports cage assembly as defined in claim 11, including a pair of tie-down assemblies for attaching a lower portion of the forward ball impact panel to a horizontal floor surface including a low profile ring assembly less than one-half inch in height and permanently attached to the floor surface, and a clip assembly attachable to the ring assembly and connected to a lower end of the forward ball impact panel.

14. A sports cage assembly as defined in claim 11, including a second pair of base members in the side tracks spaced from and connected to the first base members for supporting the forward ball impact panel below the spaced tracks in a stowed position.

* * * * *